United States Patent [19]

Cardozo

[11] 4,237,710

[45] Dec. 9, 1980

[54] LOCKING DEVICE

[76] Inventor: David L. Cardozo, 93, Boulevard Mettewie, Molenbeek-Saint-Jean, Belgium

[21] Appl. No.: 941,363

[22] Filed: Sep. 11, 1978

[30] Foreign Application Priority Data

Sep. 13, 1977 [BE] Belgium ..... 858654

[51] Int. Cl.[3] ..... E05B 59/00

[52] U.S. Cl. ..... 70/108; 70/116; 70/120; 292/6

[58] Field of Search ..... 70/108, 107, 120, 109, 70/110, 116; 292/5, 6

[56] References Cited

U.S. PATENT DOCUMENTS

| | | | |
|---|---|---|---|
| 4,037,440 | 7/1977 | Shabtai et al. | 70/108 |
| 4,154,070 | 5/1979 | Bahry et al. | 70/108 |

FOREIGN PATENT DOCUMENTS

| | | | |
|---|---|---|---|
| 1363387 | 5/1964 | France | 70/107 |
| 472674 | 7/1952 | Italy | 70/107 |
| 566784 | 9/1957 | Italy | 70/107 |

*Primary Examiner*—William E. Lyddane

*Attorney, Agent, or Firm*—Scully, Scott, Murphy & Presser

[57] ABSTRACT

There is described a locking device for closing panels, particularly doors or windows, comprising a dead lock and a spring lock biased by spring means to a projecting position relative to the panel, as well as a cylindrical safety block, which comprises a driving arm with on the one end thereof at least one groove into which is engaged the cylindrical safety block projection during the rotation thereof by means of the key, in such a way as to impart to said arm a translation movement, said driving arm being connected with the other end thereof to a plurality of locking members which are guided inside the panel, so as to cause the entering into or the release from corresponding keepers under the action of the translation movement thereof.

5 Claims, 1 Drawing Figure

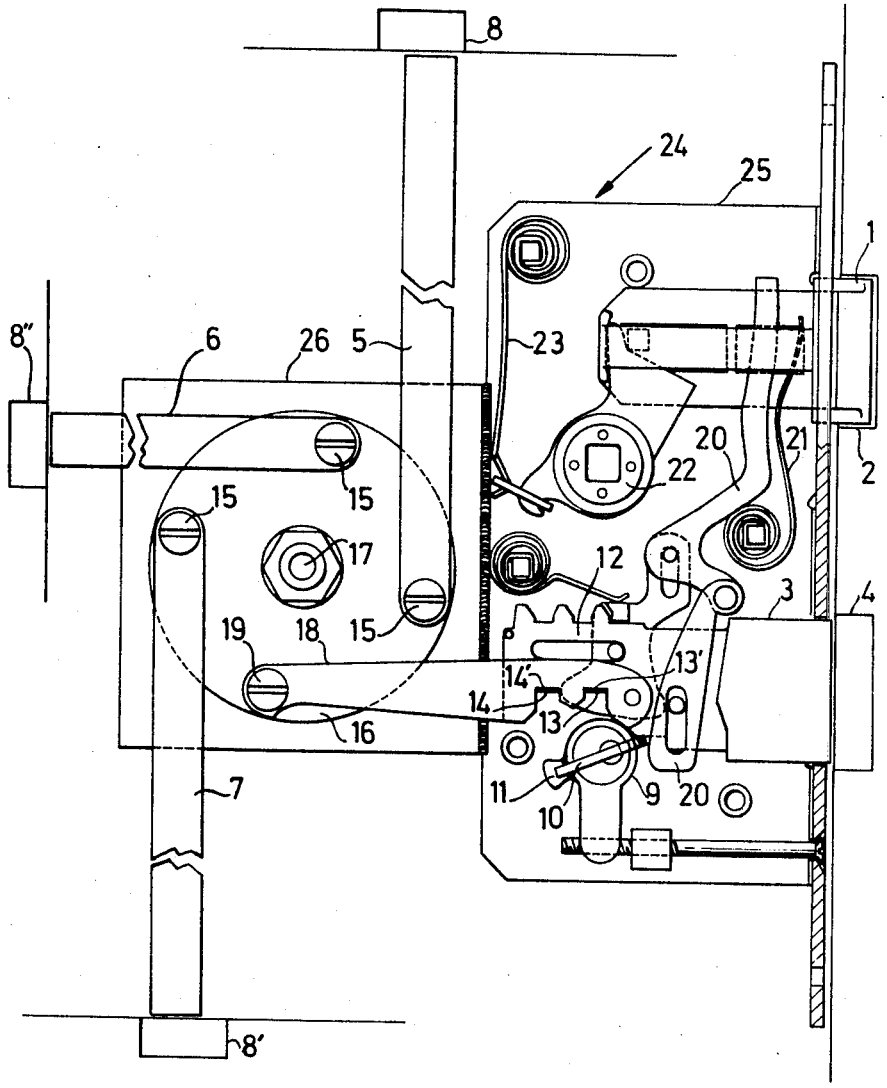
8
24
25
1
8"
6
26
5
23
20
21
22
2
15
15
17
12
3
4
19
18
15
13'
14'
14
13
16
11
9
20
10
7
8'

LOCKING DEVICE

This invention relates to a locking device for closing panels, particularly doors or windows, comprising a dead lock and a spring lock biased by spring means to a projecting position relative to the panel, as well as a cylindrical safety block, going through the panel thickness and operatable by a key on either side of said panel, a projection being so provided on the cylinder as to enter under the pushing action of the key at least one groove provided on the dead lock tail and to impart thereto a translation movement in and out of a corresponding keeper, said projection driving by the action thereof the spring bolt to the retracted position inside the panel against the action of said spring.

There are already known locking devices for locking door panels, so-called multiple-point safety locks, which comprise safety rods to be anchored in a plurality of points on the door frame. Said locks are mortised in the panel center and the cylinder into which the key is fitted and which allows to operate the safety rods goes through the door panel thickness. Said known locking devices have the drawback that they comprise a large metal body in the door center, that is a body which is a good heat conductor, and they require besides the opening already provided for the passage of the conventional lock cylinder, the provision of an additional passageway for the operating cylinder proper thereof. This is a large drawback from the fire-resistance aspect and this to such a degree that doors provided with such safety locks are generally rejected by offical safety administrations in some countries when said doors are to be used as fire-guards. On the other hand even when both operating cylinders are identical and require but the use of a single key, the opening or closing of the door requires two succeeding operations.

From Belgian Pat. No. 823,021 is for instance already known a closing device of this kind comprising a cylinder provided with gear means for cooperating with a gear wheel to which are connected through curved links, at least two bolts which are driven to the closing or opening position by the rotation of the gear wheel under the action of the toothed cylinder. To obviate said drawbacks, it is proposed in Belgian Pat. No. 855,907 to adapt to the device according to Belgian Pat. No. 823,021, a spring bolt associated with a biasing spring and so arranged as to be driven under the action of the key through a second gear wheel and operating levers driven by said gear wheel.

Said device has still however the drawback that it cannot be adapted on doors, notably fire-guard doors, which are provided with a completely conventional locking device as described in the preamble to this description. The user wishing to enhance the locking safety of such a door has to secure not only a completely new locking device but also quite possibly a new panel due to the difference in shape of the housing provided to house said device. On the other hand, said device comprises a relatively intricate mechanism which is consequently costly.

Such problems have been solved according to the invention with a locking device for closing panels which comprises a driving arm with on the one end thereof at least one groove into which is engaged the cylindrical safety block projection during the rotation thereof by means of the key, in such a way as to impart to said arm a translation movement, said driving arm being connected with the other end thereof to a plurality of locking members which are guided inside the panel, so as to cause the entering into or the release from corresponding keepers under the action of the translation movement thereof.

In an advantageous embodiment of the invention, the driving arm is mounted on the dead lock tail in such a way that the driving arm grooves coincide accurately with the grooves provided on the dead lock tail and the safety block projection as it enters a dead lock groove, also enters simultaneously a driving arm groove.

In another embodiment of the invention, the dead lock tail and the driving arm comprise one and the same part which is provided with the grooves required for the operation thereof by the cylindrical safety block projection.

In a very advantageous embodiment of the invention, the locking device is received inside a housing which is mortised inside a single recess of the panel, in such a way that the operating mechanism only goes through the door thickness.

Other details and features of the invention will stand out from the following description given by way of non limitative example and with reference to the accompanying drawings, in which the single FIGURE is a plan view of a locking device according to the invention.

In the embodiment of the invention as shown in the accompanying FIGURE, the locking device comprises a spring lock 1 by way of fixing member for the door panel, which lock in the door closing position enters a corresponding keeper 2, a dead lock 3 which is used as panel locking member and enters a keeper 4 provided on a side upright of the fixed panel frame, and three safety rods 5, 6 and 7 which are guided inside the closing panel and in the locking position, are anchored in different locations of the fixed panel frame, into keepers provided therefor, as well as an operating mechanism in the shape of a cylindrical safety block 9 into which can be fitted a key 10, on either side of the panel. The anchoring rods 5 and 7 are arranged vertically inside the panel, the rod 5 being anchored inside a keeper 8 provided at the top of the fixed panel frame and the rod 7 inside a keeper 8' provided in the ground or in the frame sill. The rod 6 is arranged horizontally inside the panel and goes through the width thereof substantially from side to side to enter a keeper 8'' provided therefor on that side upright of the fixed panel frame opposite the upright inside which is mortised the keeper 4 for the dead lock 3.

The cylinder of the safety block 9 is provided with a projection 11 which under the action of the key 10, can be caused to swing about the cylinder axis. In the embodiment shown in the FIGURE, the safety block is so arranged as to allow from the unlocking position of the panel, to rotate the projections over two complete revolutions by means of the key, in the one direction about the cylinder axis which gives a double-locking, or to rotate the projection in the opposite direction over half a revolution which causes the release of the spring lock 1.

The tail 12 of the dead lock 3 is provided with two grooves 13 and 14 inside each one of which the driving projection 11 of the cylinder 9 enters in sequence as it performs a double revolution about said cylinder under the action of the key. Said tail 12 thus drives the dead lock 3 as said tail passes through the grooves 13 and 14 in the suitable direction for a release from the keeper 4 or for entering said keeper, depending on the revolution direction about cylinder 9.

Each one of the anchoring rods 4, 5 and 6 is connected through swivel-pins 15, to a plate 16 which is swingable about a horizontal axis 17. A driving arm 18 is swingably mounted by the one end thereof on the tail 12 of the dead lock 3 and by the other end thereof, on a swivel-pin 19 which is arranged on plate 16. Said driving arm is also provided with grooves 13' and 14' inside each one of which enters in sequence the driving projection 11 as it swings about the cylinder 9. The projection 11 which under the action of key 10, rotates about the cylinder 9, imparts as it passes through the grooves 13' and 14', a translation movement to the driving arm 18. Said arm 18 causes the plate 16 to swing, which causes in turn the rods 5, 6 and 7 to move out vertically or horizontally depending on the vertical or horizontal guiding thereof inside the panel.

In the embodiment as shown, a portion of the driving arm 18 overlaps a portion of the tail 12 of dead lock 3 in such a way that the grooves 13' and 14' of driving arm 18 coincide accurately with the grooves 13 and 14 in the tail 12 of dead lock 3. By means of such an arrangement, the driving projection 11 of the cylindrical safety block 9 as it enters a groove in dead lock 3, enters simultaneously the corresponding groove of the driving arm 18, which allows to engage or release the dead lock 3 and the three safety rods 5, 6 and 7 relative to the corresponding keepers 4, 8, 8' and 8'' thereof.

As the driving projection 11 of the cylindrical safety block 9 is swung by a half-revolution in that direction opposite to the direction corresponding to the engagement of the locking members, and when the locking device is in the unlocked position, the projection 11 operates a set of hinged levers 20 which release the spring lock 1 from the keeper 2 inside side which same lies, against the action of a spring 21 which returns the spring lock 1 to the engaged position as soon as the projection 11 stops pushing the hinged lever set 20. The spring lock 1 may be disengaged in the same way by means of a handle the bottom 22 only of which is shown and which is provided but on one side of the panel, against the action of spring 21 which biases the spring lock 1 to the engaged position as soon as the action of handle 22 stops and against the action of a spring 23 which returns the handle to the original position thereof as soon as the operating force thereon causing the swinging of the handle is discontinued.

The locking device according to the invention is received inside a housing 24 which is mortised inside a single recess in the panel. Said housing 24 is formed in the embodiment as shown, by two bearing plates 25 and 26 joined together in any suitable way, and a cover not shown. The housing 24 is mortised inside the single recess in the panel through a cut-off in the panel edge, or else in one panel side. The safety block cylinder 9 only goes through the panel thickness and could comprise a heat-conducting link. The fire-resistance of a door provided with a locking device according to the invention is equivalent to the one of a fire-guard door without safety rods. On the other hand, the door provided with a locking device according to the invention can be opened or closed in a single operation. Finally said locking device is of much lower cost than the previously known device due to the lowering in the number of parts required and the easy adaptation thereof to a lock of the conventional type with latch, spring lock and dead lock. The lock being used in the device according to the invention and which is arranged on the bearing plate 25 is an usual type made by the firm Zeiss Ikon.

It must be understood that the invention is in no way limited to the above embodiments and that many changes can be brought therein without departing from the scope of the invention as defined by the appended claims.

It would for instance be possible to provide any number of anchoring rods and such rods could be arranged in some other way.

It would also be possible to have the dead lock and the driving arm comprise a single part in which are provided two grooves for the driving thereof by the projection of the safety block.

I claim:

1. An improved locking device for closing panels, particularly doors or windows, of the type comprising a dead lock and a spring lock biased by spring means to a projecting position relative to the panel as well as a cylindrical safety block, extending through the panel thickness and operatable by a key on either side of said panel, a projection being provided on the cylinder so as to enter, under the pushing action of the key, at least one groove provided on the dead lock tail and to impart thereto a translation movement in and out of a corresponding keeper, said projection driving by means of hinged levers connected to the dead lock the spring lock to the retracted position inside the panel against the action of said spring, wherein the improvement comprises, a driving arm mounted on the one end thereof on the dead lock tail and having a least one groove which coincides accurately with one groove provided on the dead lock tail and into which the cylindrical safety block projection is simultaneously engaged during the rotation thereof by means of the key, in such a way as to impart to said arm a translation movement, said driving arm being connected with the other end thereof to a plurality of locking members which are guided inside the panel, so as to cause the entering into or the release from corresponding keepers under the action of the translation movement thereof.

2. Locking device as defined in claim 1, in which the locking members are formed by safety rods allowing an anchoring of the panel in various locations on the fixed panel frame.

3. Locking device as defined in claim 2, in which the anchoring rods and the driving arm are swingably mounted on a plate in such a way that the movement of the driving arm causes the rotation of the plate in one or the other direction, the plate imparting in turn a translation movement to the anchoring rods.

4. Locking device as defined in claim 1, which comprises an operating handle arranged on the one door side and allowing to retract the spring lock inside the panel under the return spring action, without making use of the key.

5. Locking device as defined in claim 1, which is received inside a housing which is mortised inside a single recess of the panel, in such a way that the operating mechanism only goes through the door thickness.

* * * * *